United States Patent [19]

Luth

[11] 4,031,718

[45] June 28, 1977

[54] ELECTRONIC SYSTEM FOR CENTRALLY CONTROLLING A PLURALITY OF KNITTING MACHINES

[75] Inventor: Claus-Peter Luth, Florence, Italy

[73] Assignee: Macchine Tessili Circolari MATEC S.p.A. of Roma, Italy

[22] Filed: June 12, 1975

[21] Appl. No.: 586,157

Related U.S. Application Data

[63] Continuation-in-part of Ser. No. 387,514, Aug. 10, 1973, abandoned.

[52] U.S. Cl. ..... 66/154 A; 66/155; 235/151.1

[51] Int. Cl.[2] ..... D04B 15/66; D04B 15/78

[58] Field of Search ..... 66/154 A, 155, 50 R; 235/151.1

[56] References Cited

UNITED STATES PATENTS

| | | | |
|---|---|---|---|
| 3,035,426 | 5/1962 | MacQueen | 66/154 A X |
| 3,232,079 | 2/1966 | Levine et al. | 66/154 A |
| 3,776,003 | 12/1973 | Krause | 66/154 A |
| 3,831,402 | 8/1974 | Schuman | 66/50 R |
| 3,844,139 | 10/1974 | De Cerjat | 235/151.1 X |
| 3,985,002 | 10/1976 | Kouklik et al. | 66/154 A |

FOREIGN PATENTS OR APPLICATIONS

| | | | |
|---|---|---|---|
| 1,583,356 | 9/1969 | France | 66/154 A |
| 1,000,029 | 8/1965 | United Kingdom | 66/155 |
| 1,194,731 | 6/1970 | United Kingdom | 66/25 |

*Primary Examiner*—Eugene G. Botz
*Attorney, Agent, or Firm*—Clifton T. Hunt, Jr.

[57] ABSTRACT

A plurality of machines, such as circular hosiery machines, are controlled at preselected times during a knitting cycle by a central control unit. Each machine includes, in addition to the needle cylinder, a revolutions counter and angular position detector cooperatively connected to the cylinder, as well as actuators which change or vary the operations performed on the article by the cylinder. If desired a size-change unit may be provided for each machine to vary the sizes of the body, leg, and foot of articles produced. A cyclical switching generator successively and individually feeds information from the angular detector and revolutions counter into a central control unit from each machine as well as feeding information from the central control unit to the actuators of each machine, so that, for any position and after a prescribed number of revolutions of each machine, prescribed knitting functions may be directed. At any one time the cylinder position and functions may vary from machine to machine, whereby the operation of each machine is independent of the others.

5 Claims, 10 Drawing Figures

ANGULAR POSITION DETECTOR DEVICE

ELECTRONIC SYSTEM FOR CENTRALLY CONTROLLING A PLURALITY OF KNITTING MACHINES

RELATED APPLICATION

This is a continuation-in-part of application Ser. No. 387,514 filed Aug. 10, 1973, now abandoned and entitled ELECTRONIC SYSTEM FOR CENTRALLY CONTROLLING A PLURALITY OF KNITTING MACHINES.

SUMMARY OF THE INVENTION

The present invention relates to a system for electrically controlling the output of a plurality of circular hosiery machines and especially the output of stocking machines of the type wherein each machine includes a needle cylinder and a number of electrohydraulic, electromechanical or electropneumatic control members, hereinafter referred to as "actuators".

The control system, according to the present invention, basically includes information generating and receiving means for each machine, such means including an angular detector means designed to supply electrical information regarding the angular position of the respective needle cylinder; a revolutions counter means designed to count the revolutions completed by the cylinder and also designed to be reset at zero after the end of a cycle; and a plurality of actuators associated with each machine for controlling and operating the machine functions. The control system further includes, for a plurality of machines, a single central program control unit for all machines, with an angular position information (first) input means for combining the angular position output from all machines; a revolutions information (second) input means for combining information regarding the number of revolutions completed by all machines; and a control information output means for sending control signals to the actuators. Finally, a fast switching means enables temporarily and cyclically the central unit to receive information concerning angular position and revolutions completed from each of the machines and to immediately supply control information to the actuators of each machine relative to the position wherein it is temporarily detected or found.

More specifically the aforementioned switching unit preferably includes a cyclical switching generator with a plurality of outputs equal in number to the number of machines to be controlled; an angular position cyclical (first) switch which receives the information from the angular detectors of all the machines and is switched to successively transmit the angular position information from each machine to the central unit; a revolutions counter cyclical (second) switch is operated by the switching generator to successively transmit the number of revolutions completed by each machine to the central unit; and a third cyclical switch for distributing control signals from the central control unit to each machine. The three switches are operated by the cyclical switching generator in such a manner that instantaneously the central control unit is instantaneously and successively connected through the three switches to each knitting machines to receive the information therefrom and provide the appropriate control signals. The switching frequency is such as to successively connect in sequence all the machines to the central control unit in less time than it takes for a needle cylinder under maximum speed conditions to travel the angular path between two contiguous angluar positions of the cylinder (for example one-sixteenth of a revolution).

Each machine also advantageously includes a size-change device, which receives pulses from the revolutions counter and pulses from the control unit. The size-changing device includes partial counters with decoding systems and activated by means of the count pulses; conicidence circuits set up in prescribed combinations by means of a bank of size selector switches; and flip-flop bistable switches or the like, designed to enable the main revolutions counter to progressively count or to interrupt the count thereof respectively with a polarity inverter, and simultaneously to set at zero the partial counters and respectively activate them to count during the time the main counter is interrupted. Through said size selector switches, the interruption time (revolutions during which the main counter is interrupted) of the main counter may be modified and thus the dimensions of a corresponding part of an article can be varied.

Each angular detector includes a drum or the like, mechanically connected with a 1:1 ratio to the cylinder of the respective machine. The drum includes a conventional "Gray" code and is arranged to cooperate with four sensors such as photocells for generating and transmitting information regarding angular position of the cylinder to the angular position cyclical switch. A NAND gate or the like with four inputs corresponding to the outputs of the four sensors is combined with each angular detector for the forming of the revolutions count pulses, which pulses are supplied both to the revolutions counter and to the sizechange device.

The central unit includes a plurality of NAND logic gates with four inputs, the gates corresponding in number to the number of different controls to be made in accordance with the program. The inputs of said gates are connected to the outputs from the decimal decoding units corresponding to the angular position switches and revolutions information switches, and the outputs of said gates are connected to the controls distribution cyclical switch.

The cyclical switching generator includes an oscillator, a pulse forming unit, a module $n$ binary counter (where $n$ is the number of the machines) and a decoding unit for translating from binary to one of the decimal numbers $1-n$ so that the information of the $n$ switchings may be fed to the switches.

One object of the invention is to provide an electrical control system wherein some components are common for all the machines, although each machine is designed to operate independently with respect to the others or to make pattern shifts independently with respect to the others.

Another object of the invention is to provide a control system for a plurality of machines which affords structural simplicity, high performance, and easy use.

These and other objects will become obvious to those skilled in the art by reading the following specifications in conjunction with the drawings in which:

The invention will be better understood following a reading of the specification with the accompanying drawings, which illustrate one embodiment of the invention, however, is not restricted thereto.

As it appears from an examination of FIG. 1, the central control unit 1, which together with its components hereinafter described, is common for a certain *n* number of machines. The central unit 1 feeds control information contained in a single central program for all the *n* machines, the program being easily replacable, as in practice it is represented by printed circuit cards, pre-wired panels, or the like.

Figure 1:
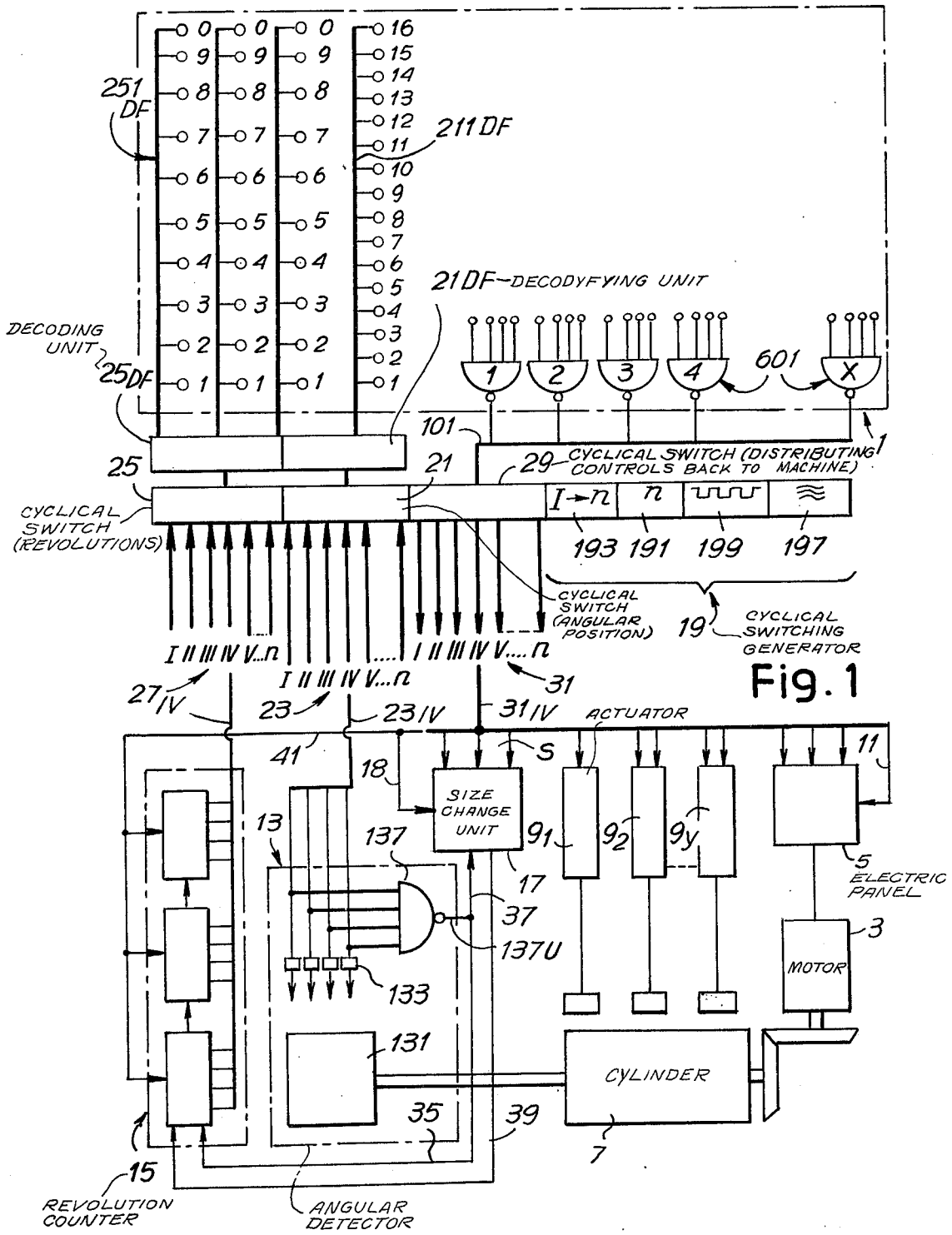
FIG. 1 illustrates a schematic block diagram of the electrical control system according to the present invention.

In FIG. 1, only the number IV machine of all the machines (*n* in number) is shown. In this machine 3 denotes the motor, 5 the associated electric panel, 7 the cylinder, $9_1, 9_2, \ldots 9_y$ a certain number of actuators of the operation of the machine, such as yarn-guide controls, slider cam controls, solenoid valves, and the like. The actuators are operated by pulses from the central unit 1, each of said actuators requiring one, two, three or more controls, i.e. pulses from corresponding channels, to carry out its own designated function. In the diagram of FIG. 1 the actuator $9_1$ requires a single pulse, the actuators $9_2$, $9_y$ two pulses from two different channels, the panel 5 requires pulses from three channels plus a pulse from a line 11 for the stopping of the system. In total each machine may require up to *x* channels. Each machine also includes an angular detector 13, a main revolution counter 15, and a size-change unit 17, for modifying particular lengths of the article (in a stocking or collant, for instance the body, leg, and foot), electrically connected with both the angular detector 13 and the revolutions counter 15.

The central control unit is combined with piloting accessories of the same and transformation and distribution means for the incoming and outgoing signal information. Basically, the fast switching means includes a cyclical switching generator 19, an angular position cyclical switch 21, to which information regarding the angular positions of the cylinder arrives from the angular detectors 13 of each machine, through *n* four-pole conductors 23 (including conductor $23_{IV}$ of the number IV machine); a revolutions cyclical switch 25 to which information regarding the number of revolutions completed by each machine arrive from counters 15 through *n* conductors 27 having twelve channels each (including conductor $27_{IV}$ of the number IV machine); a cyclical control distribution switch 29 fed by the central control unit, and through which are distributed selectively and consecutively to *n* multiple conductors 31 information from each of the channels (of which the $31_{IV}$ channel is particularly visible) for the *n* machines. Decoding units 21DF and 25DF are combined with the cyclical switches 21 and 25 respectively.

A more detailed description of each of the aforementioned components follow.

Figures 2, 2A:
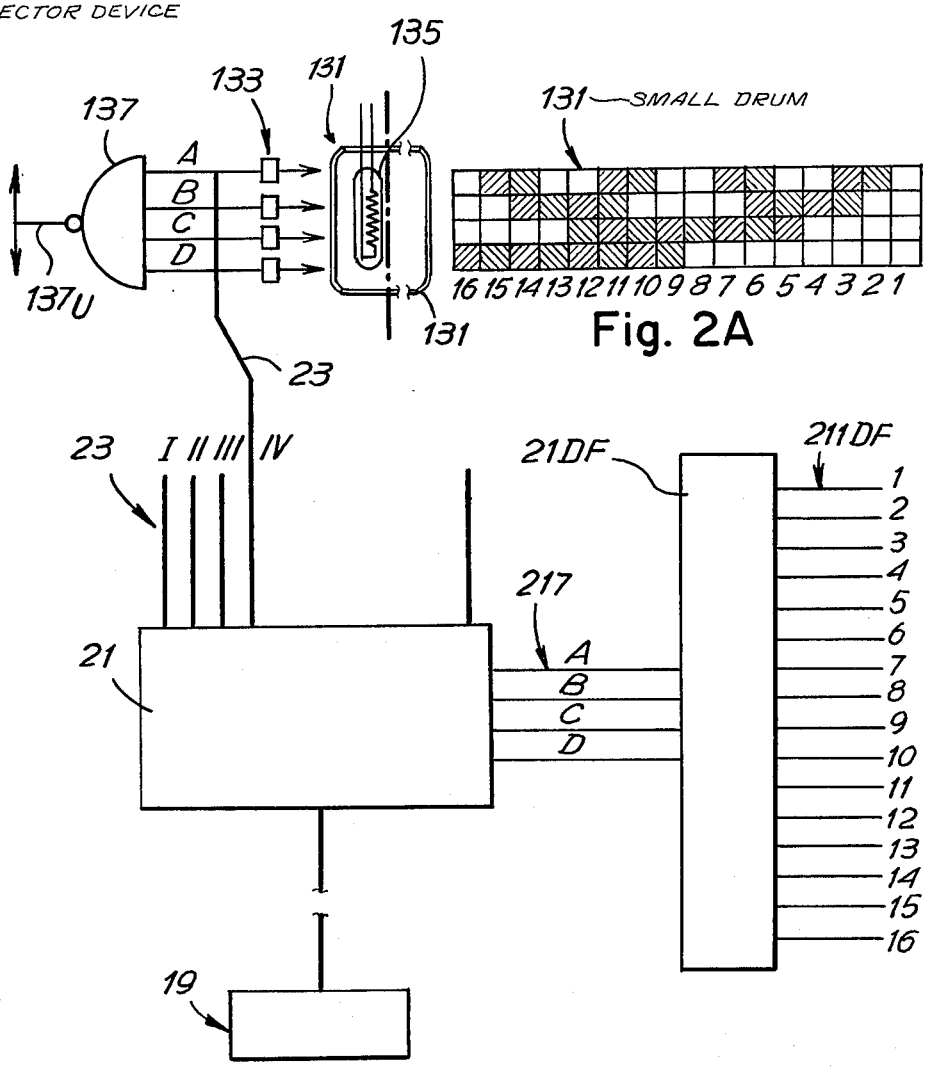
FIGS. 2 and 2A illustrate schematically the angular detector and a development of a associated engraved shell for "Gray" code.

Each machine from I, II, III . . .to *n* is provided with an angular detector device 13 designed to create electric signals of th angular positions of the needle cylinder. Turning now to FIG. 2, this device includes a small drum or disk 131 (shown in development in FIG. 2A) with "Gray" code engravings. Through the "Gray" code which involves a different combination of transparent and non-transparent patches on the four tracks for each angular position, one obtains a positive and reliable reading. The detection of the position of the drum or disk 131 (which has a ratio 1:1 with respect to the needle cylinder), occurs by means of four photosensors or photocells 133 which are illuminated and energized by a lamp 135 positioned on the opposite side of the tracks engraved on the drum or disk and according to FIG. 2 in the drum interior. Magnetic, ultransonic, capacitive sensors or the like may replace the photosensors. These photosensors 133 emit a positive voltage when they are illuminated and a negative voltage when not illuminated. If one of the sensors is adjacent a non-transparent patch on its corresponding track, it is not illuminated, but if adjacent a clear or transparent patch, it is illuminated. The four wires of the photosensors 133 of the machine IV, which are re-united in the four-pole conductor $23_{IV}$ of the Iv machine, end up at the angular postion cyclical swtich 21 of the central unit, as is also the case with the other groups of four wires from the angular detection devices, of the machines "I" to *n*. Each of these *n* groups of four wires is cyclically connected with the four inputs 217 (ABCD) of the decoder converter 21DF, which in turn is of the Gray code to a "1 of 16" type. Always a single one and only one of the sixteen outputs 211DF of the decoder bears a positive voltage, thus directly indicating the angular position among the sixteen possible positions of which, as an example only, the round angle of the needle cylinder is divided. Thus at the prescribed moment the angular position is connected with the program of the central unit. This signal, for instance, relating to machine IV only exists for the short time in which the central control unit 1 is available for machine IV, which short time is caused by the switching generator 19. To create an univocal signal of the position 1 of the needle cylinder, which serves to advance the counting of the revolutions counter 15, a logic gate 137 of the NAND type, which produces on the output a negative voltage when all the four inputs are positive, is connected to the outputs of the four sensors. This takes place only in the position 1 (where all four sensors are illuminated) of the detector drum 131 and thus in the same position of the cylinder. From the output 137U of the gate 137, the count signal is transmitted through conductor 35 to the revolution counter 15, and simultaneously through conductor 37 to the size-change unit 17, for hereinafter indicated purposes.

Each of the *n* machines is provided with a revolutions counter 15 operatively connected to the respective cylinder 7. Counter 15 which may count from 0 to 999, is advanced in the count by means of the pulse or signals from gate 137 which indicates the position 1 of the needle cylinder. The three decades 151, 153, 155 (units, tens, hundreds) of the counter 15 supply in binary code (especially in BCD code) the revolutions count to the revolutions cyclical switch 25 through the line $27_{IV}$ together with the similar information from the corresponding counters of the other machines. These *n* groups 27 and 12 wires each (4 for the units, 4 for the tens, 4 for the hundreds) coming from the *n* machines are alternately and consecutively connected with the inputs 251 (three groups of four wires each) into the three decodifying units (BCD to DECIMAL) indicated by 253DF, 255DF and 257DF of the decoding unit 25DF. The switch 25, operated by the cyclical switching generator 19, transmits the information pertinent to one of the *n* machines when the central unit is instantaneously set up to receive information from that machine.

The signal is presented as a positive voltage always and only on one of the ten outputs of each of the three decodifying units 253DF, 255DF, and 257DF. For instance, let us assume that the wire 3 of the units decoder 253DF is positive the wire 6 of the tens decoder 255DF is positive and the wire 2 of the hundreds decoder 257DF is positive. The corresponding machine, which at this instant has access to the central unit 1, is located in revolution 263 of the cycle.

The enabling-counting input 39 insures that the counter is counting pulses coming from the line 35 only when said input has a positive voltage. The size-change device 17, from which the input line 39 derives, paralyzes the counter 15 through this input 39 by emitting a negative voltage. A zeroing line 41 sends to the counter 15 a negative voltage pulse at the end of the production cycle, to set at zero the three decades 151, 153, 155 of the counter 15, thus allowing the start of a new cycle in the machine.

Before completing the description of the individual machine components, it should be noted that each operational machine from "I" to *n* is alternately and successively connected through certain input conductors 23 and 27 and output conductors 31 with the central unit 1, which supplies control information contained in the single central program to the corresponding single machine. This information is successively supplied for all the machines form "I" to *n* (not synchronized on another) and this occurs for all of the *n* machines in a period of time shorter than the time span which occurs during a sixteenth of a rotation of the needle cylinder with the maximum possible speed. In other words, during a time period shorter than 1/16th of a revolution of a cylinder at the highest running speed, each of the *n* machines will have received the pulse or pulses pertinent thereto corresponding to the revolution and angular position in which it is located. Thus at all the machines the program work information arrives sixteen times during every revolution of the cylinder, said information corresponding to the position wherein each machine is located independent of the other machines.

The assembly of the cyclical switch generator 19, angular position switch 21, revolutions switch 25, and control distribution switch 29 cyclically activate the central unit 1 in such a manner that it receives, with each cycle, the information from each machine through conductors 23 and 27 and emits towards said machine the control information through conductor 31.

Figure 4:
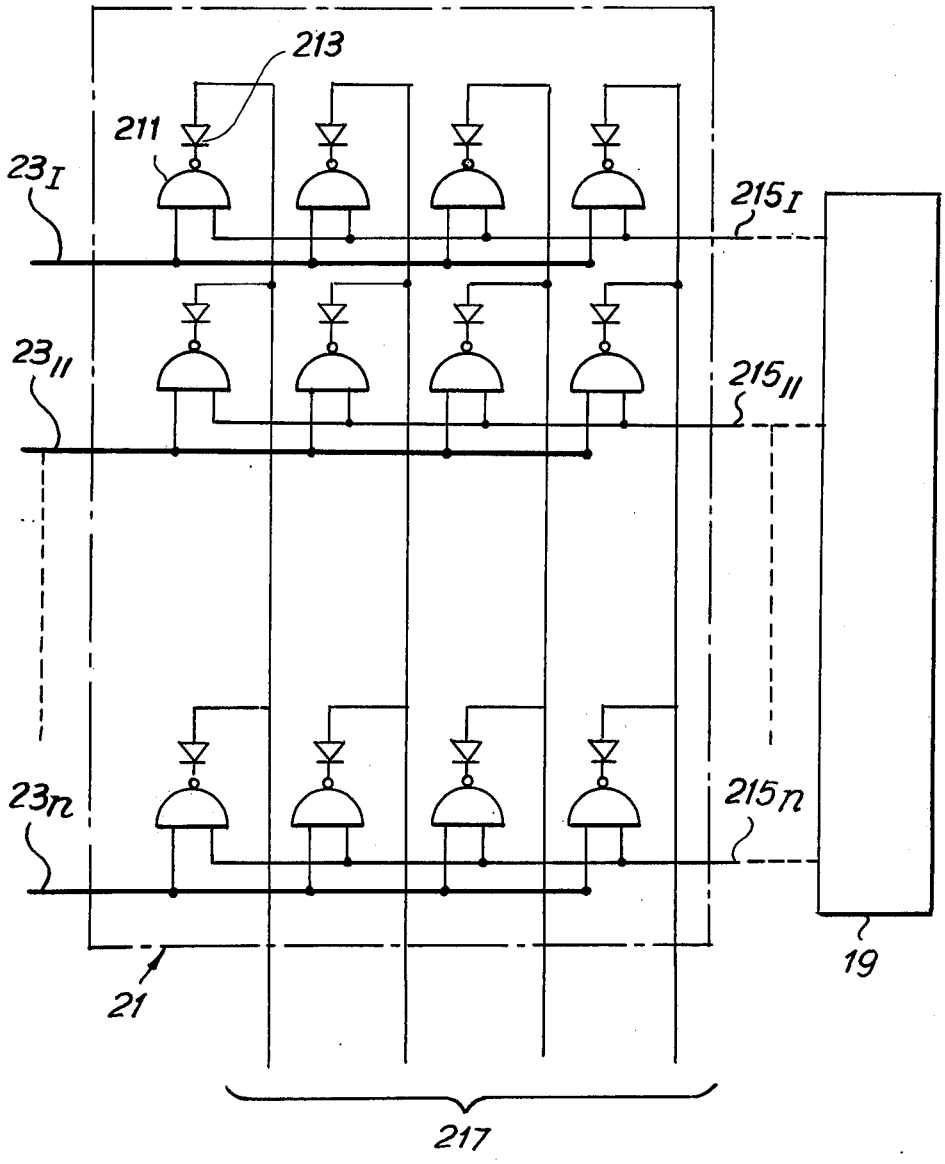
FIG. 4 illustrates schematically the angular position switch.

The angular position cyclical switch 21 (see FIG. 4) includes $n \times 4$ gates 211 of the NAND type each having two inputs and a discoupling diode 213 at the output. The four wires of the conductors 23 leading from each machine bearing the information of the angular position of the cylinder, arrive at the corresponding one of the *n* groups of four NAND gates 211, each terminating on the input of one of the four gates. The designated group of four gates 211 then passes the input information when a simultaneous signal arrives from the respective *n* wires $215_I$, $215_{II}$, . . .$215_n$ coming from the generator 19. Thus a single input from the *n* inputs 23 on the common four-pole output 217 is transmitted and reaches the decoder 21DF, which supplies the sixteen outputs 211DF.

The revolutions cyclical switch 25 operates exactly in the same manner, with the only difference being that there are 12 wires to be switched instead of 4. Decoder 25DF has three groups 251DF each having ten outputs. The outputs 211DF and 251DF supply the input information to the central unit 1.

The control distribution cyclical switch 29 has the task of distributing *x* control channels 101, emitted from the central unit 1, on to the *n* machines one after another (and on to all in less than 1/16th of a revolution). The *x* wires 101 (also see FIG. 5) coming from the control program terminate at one of the inputs of the *n* groups of *x* gates 291 of the NAND type, each gate 291 having two inputs. The other input of each gate 291 of each group of *x* gates is activated in a cyclical manner to transmit the cyclical switching signal through a corresponding wire 103 of the *n* wires 103 coming from the switching generator 19.

The bundles 31 of the *x* number of output wires of each group from "I" to *n* (that is, *n* x *x* wires, i.e. *x* wires to each of the *n* machines) each go to the receiver elements such as actuators $9_1$, $9_2$. . .$9_n$, electric panel 5, and size-change unit 17 of a machine. For instance, the *x* wires of the conductor to bundle $31_{IV}$ go to the components of machine IV. Always only one group at a time carries a signal so as to pass up to *x* information of control to a designated machine.

Sending of the controls to the *n* machines takes place *n* times during a time period shorter than 1/16the of a revolution of the cylinder under maximum speed conditions.

In order to obtain the quick distribution of the arrival and departure information, the aforementioned cyclical switching generator 19 is used.

Figure 3:
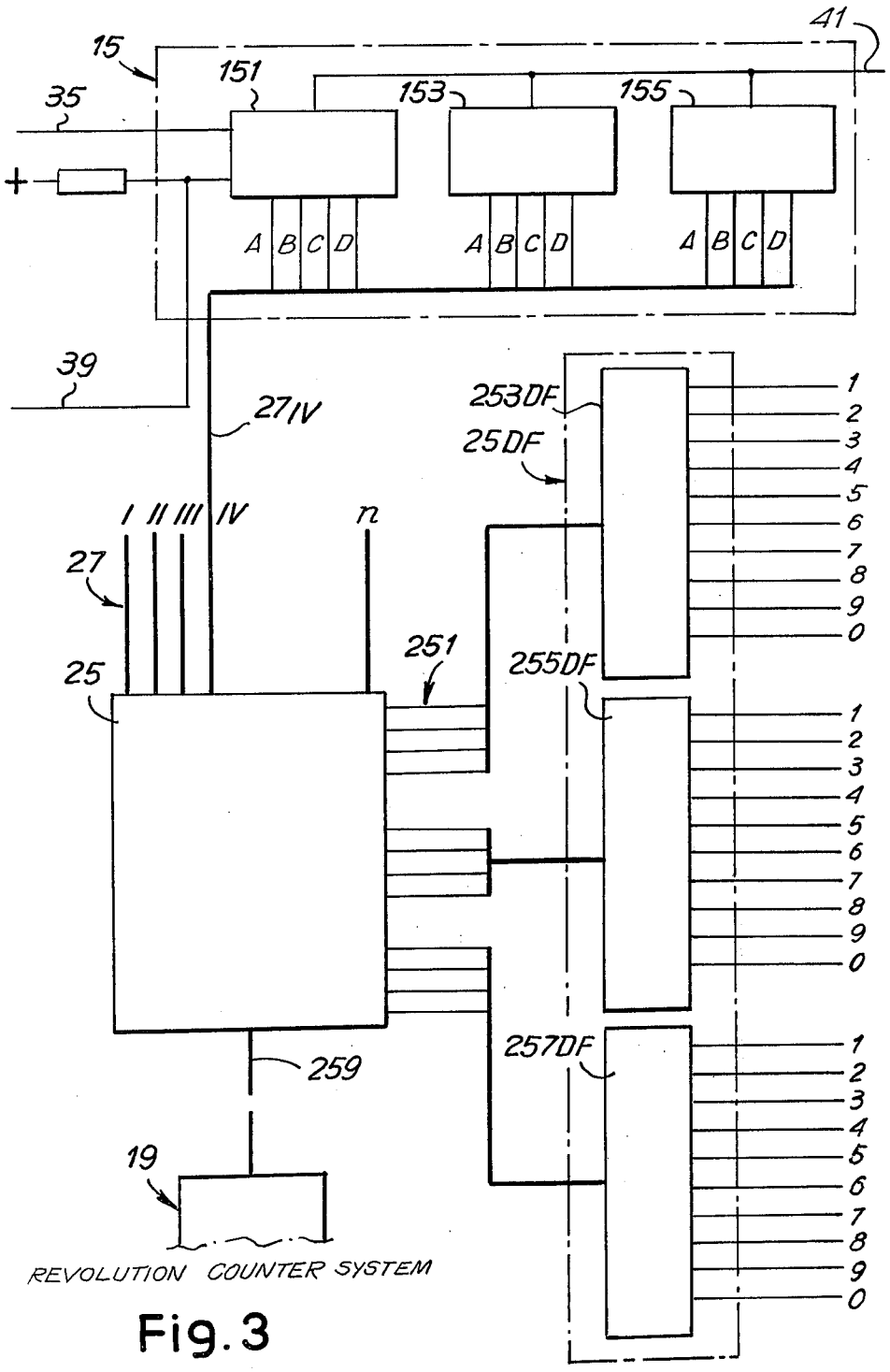
FIG. 3 illustrates schematically the revolutions counter and its associated cyclic swtich and decoding unit.
Figure 5:
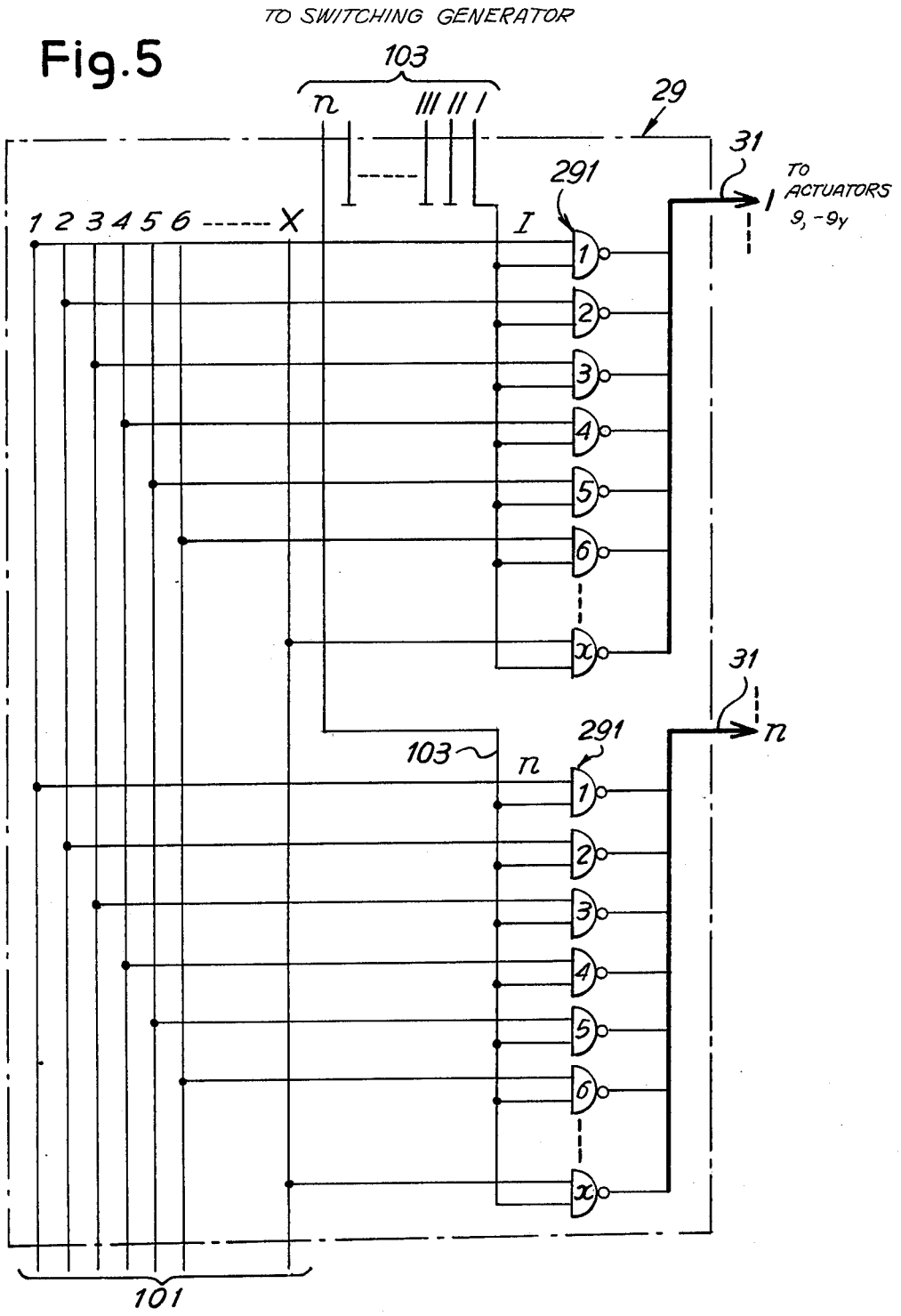
FIG. 5 illustrates schematically the control distribution cyclical switch.
Figure 6:
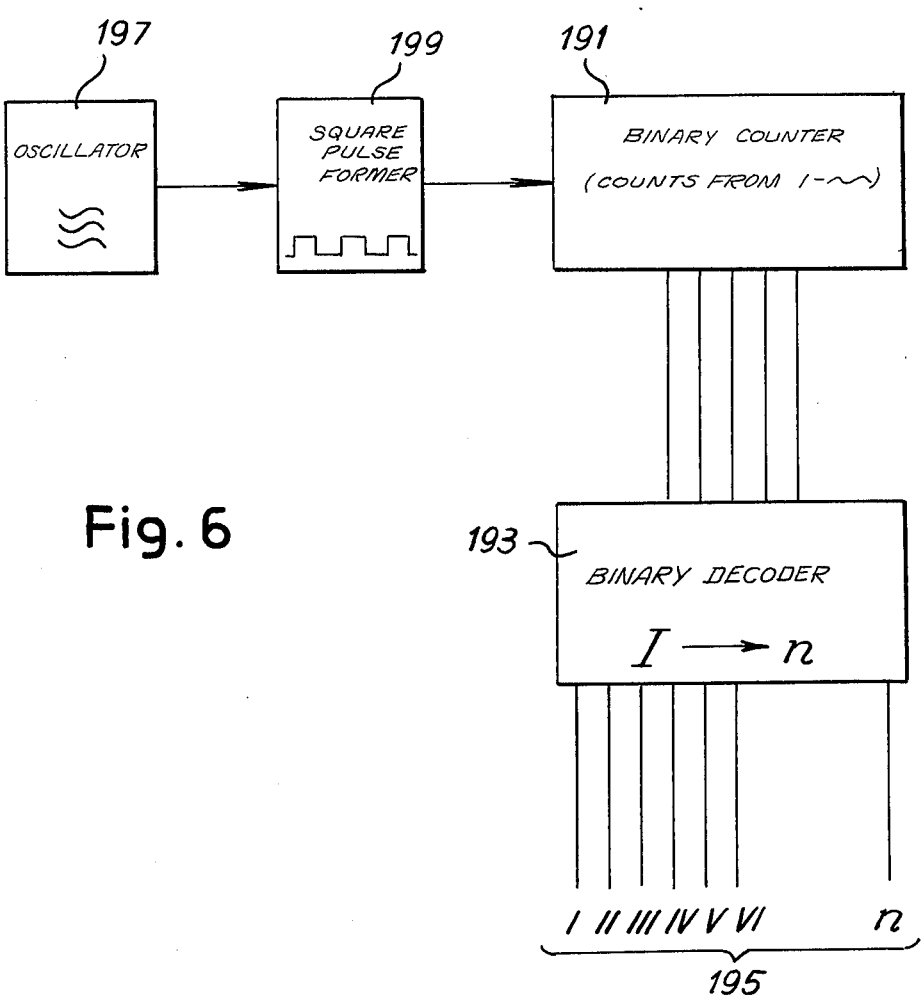
FIG. 6 illustrates schematically the cyclical switching generator.

This cyclical switching generator 19 (also see FIG. 6) includes a binary counter 191 having an *n* module and a binary to decimal decoder 193 having activating outputs 195 numbering from "I" to *n* which lead to the inputs 103, 215, 259. The advance of the counter 191 is effected through pulses coming originally from a high frequency oscillator 197 and treated in a square pulse former 199. The counter 191 advanced by "one" for each input pulse coming from the former 199. Once advanced to *n*, the counter is automatically reset ot zero and begins to counter again. This happens in less than 1/16th of one revolution of a cylinder at its maximum speed. The binary code of the counter output 191 undergoes a decoding into one of the *n* outputs in the decoder 193, and thus one has available *n* wires 195 for the activation of the groups of NAND gates 211 and 291 of the cyclical switches 21 (FIG. 4), 25 (FIG. 3) and 29 (FIG. 5).

The oscillator frequency will be chosen as already stated in such a manner that the counter effects a count from "I" to *n* in a time shorter than the minimum time required in a machine to run a sixteenth of one revolution of the needle cylinder with the maximum speed.

For each 1/16th advancement of the needle cylinder all of the NAND gates 601 are enabled by virtue of the face that during each 1/16 revolution successive moments of control are obtained, such moment corresponding to one of the connected machines. During a given moment all the gates 601 in the program enabled to control are connected to their corresponding actuators $9_1$– $9_Y$ of the respective machine to which machine this moment of control is intended. One or more actuators of said machine can in this way be acutated at the same time in the machine in question. At a successive moment during each sixteenth of revolution, it is another machine that is controlled, and the conditions of the gates 601 change to correspond to the state of the machine in question as regards the formation of its respective product. Correspondingly, the actuators $9_1$ – $9_Y$ to be controlled are different. All the successive moments of control correspond in number to the number of the controlled machines and all machines are successively controlled in each 1/16 revolution.

In the illustrated embodiment of a circular hosiery knitting machine, the selection schemes are fixed and simple, without difficult patterns. For instance, the pattern may be two tuck stitches the cycle of which is repeated every 3–4 needles. To control the several slider cams in the hosiery knitting machine relatively large sectors are available, wherein there are no needle butts and during which it is possible to have a wide tolerance when a cam is actuated. This tolerance is much larger than 1/16 revolution of the cylinder because the available spaces and thus the available times are corresponding generally to 3/16 to ¼ of a revolution.

Each machine from "I" to *n* is preferably provided with a size-change device 17 (also see FIG. 7) in order to produce stockings (or other articles) with different sizes on the same machine. In the instant case, the possibility exists of varying the lengths of three zones of the stocking: body, leg, and foot.

The size-change device 17 includes three flip-flop 171, 172, 173, three coincidence circuits for the preselection of the count 174, 175, 176, three groups, each having two decimal selector switches 177, 178, 179, for preselecting the size, each group connected to one of the coincidence circuits, and a BCD code counter 180, 181 having two decades, and each respectively combined with one of two BCD-DECIMAL decoders 182, 183, each having ten outputs connected to one or the other of the sides of the selector switches 177, 178, 179.

Figure 7:
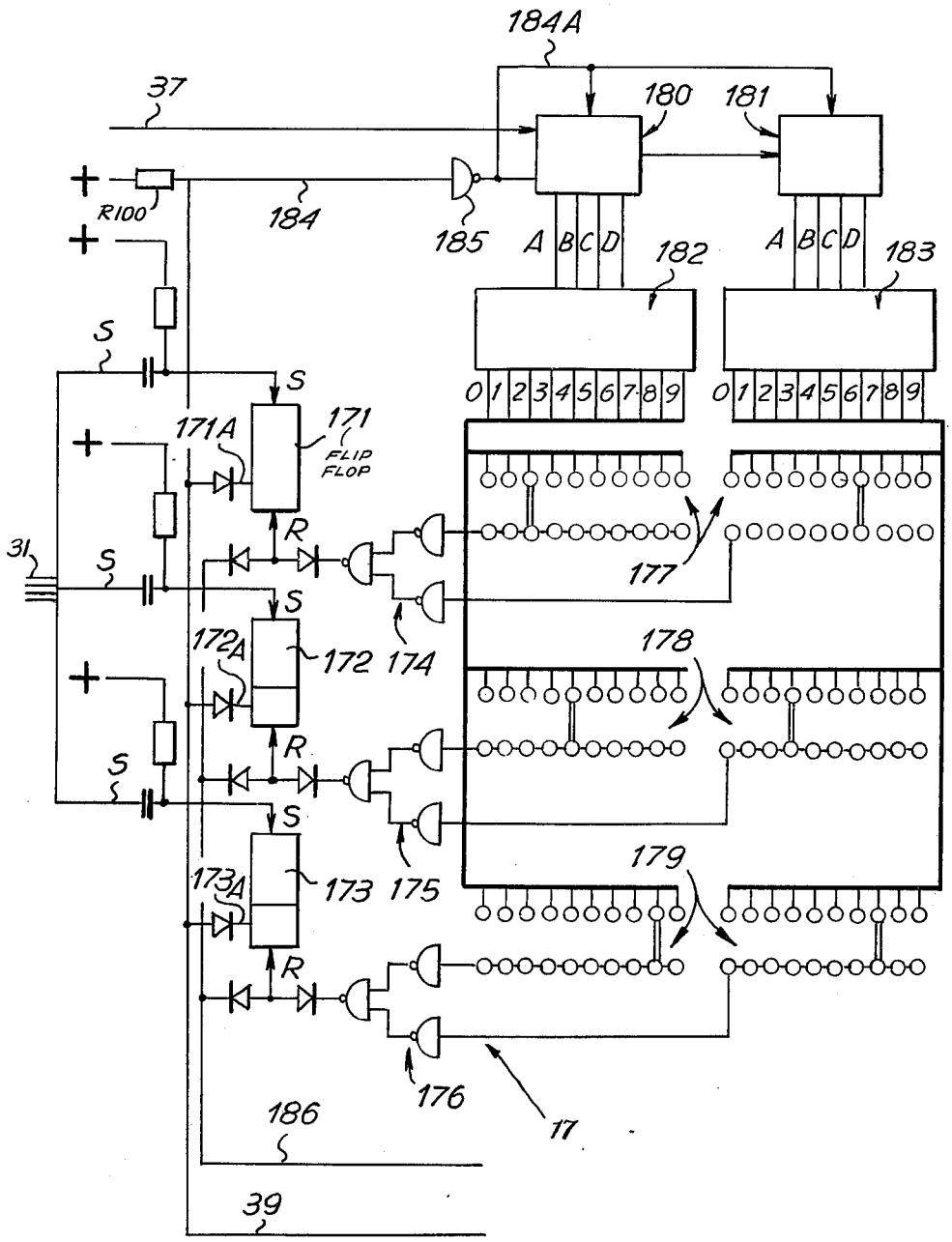
FIG. 7 illustrates schematically the size-change device.

In the size-change device rest condition, the counter 180, 181 is set to zero and not operating, because its zero setting counting inputs 184A register a negative voltage. The three flip-flops 171, 172, 173 are de-energized and carry on their outputs 171A, 172A, 173A, a positive voltage, which through the line 39 enables the revolution counter 15 of the machine to normally effect the count. When one of the three flip-flops receives from the pertinent conductor 31 a negative voltage pulse on its own input "S" (for instance, the "body" flip-flop), it changes condition and on the output 171A there is impressed a negative voltage. This negative voltage on the line 39 stops the machine revolution counter 15 and simultaneously enables by the line 184 (through a sign inverter 185) the two-decades counter 180, 181 to commence a count. Once a designated count is reached equal to a predetermined number of cylinder revolutions (62 in the setup of the switch 177, wherein the right hand group looking at FIG. 7 is that of the tens) the coincidence circuit 174 supplies to its flip-flops 171 (R input that is reset) a negative voltage. The flip-flop re-switches, sets to zero the two-decades counter 180, 181 and annuls the stoppage of the revolution counter 15 which restarts and continues to count from where it has stopped as a result of the flip-flop relocating a positive voltage on the line 39.

A zero setting signal coming from the conductor 18 (shown in FIG. 7 as line 186) acts on the sizechange device to zero set the counters and the flip-flops at the start of the cycle.

Figure 8:
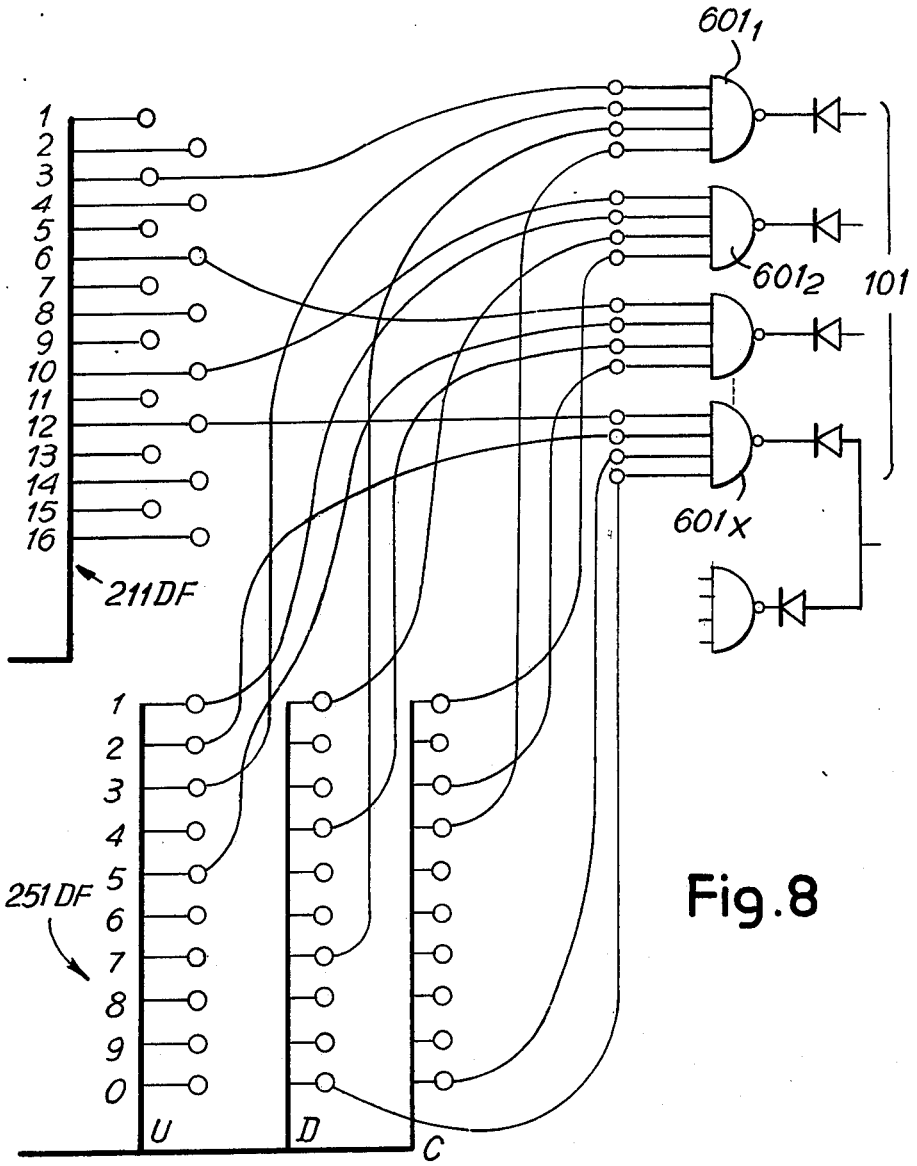
FIG. 8 illustrates a partial schematic diagram of the central unit with an example of programming.

As already stated, with the outputs 251DF and 211DF, temporarily and cyclically each machine from "I" to *n* communicates the revolution count and the angular position of the cylinder to the central unit 1 and thus to the program. In FIG. 8 a diagram of the central unit is partly shown.

On the program there is a plurality of four-input NAND gates 601, equal in number to the number of controls to be effected on the machine during the stocking cycle. Conductors 101 indicated the outputs of the gates 601.

The executive controls which terminate on the outputs 101 from "1" to *x* are the result of preselected combinations of the "revolutions" information 251DF and of the "angular position" information 211DF, connected on the inputs of the NAND gates 601. For instance, the first or upper control actuated by the first gate $601_1$, will be activated in angular position 3 of revolution 473, the U,D,C, groups being those of the units, tens and hundreds in the output 251DF of the revolutions information.

Figure 9:
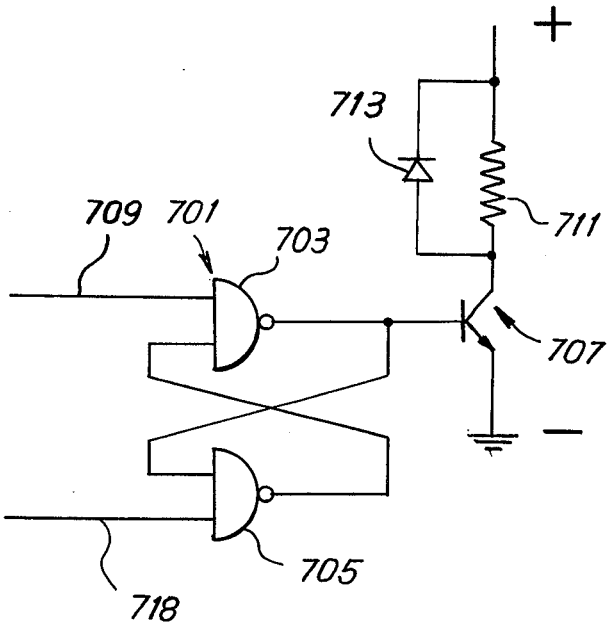
FIG. 9 illustrates schematically an example of a control amplifier for the actuators.

In FIG. 9 there is illustrated an amplifier for an actuator which includes a bi-positional control member requiring a voltage to maintain the position, as for example, an electromagnetic valve. This circuit is formed by a flip-flop 701 having two gates 703, 705 and by a amplifying switching transistor 707. When a negative signal arrives on the input 709 from control unit 1, the output of the NAND gate 703 presents positive voltage and thus determines the conduction of the transistor 707. The condition is maintained after the pulse ceases.

The winding 711 of the electromagnetic valve, run by the current, opens the value. This state remains until on the input 718 a negative control arrives, which switches the flip-flop 701 (703, 705). The output of the gate 703 returns to be negative and determines the non-conduction of the transistor. The winding 711, no longer energized, the value closes. The diode 713 protects the transistor 707 from over-voltages which are created during the turning off of the transistor.

It is intended that the drawing illustrates one embodiment as a practial demonstration of the invention, and the invention is capable of being varied in form and arrangement without departing from the scope of the invention.

What is claimed is:

1. Electronic equipment for the control of a plurality of circular hosiery knitting machines of the type having a needle cylinder and a plurality of control members, each machine being designed to operate independently of the others, said equipment including for each machine an angular detector of the respective needle cylinder, a main revolutions counter means to count the revolutions completed by the cylinder and adapted to the zero set at the end of a cycle, a plurality of actuators including signal amplifiers, a central control unit with a signal program common for all the machines and having a input of the angular position information, an input of the revolutions number information and an output for the control information for the actuators, a quick switching assembly to temporarily and cyclically enable the central unit to receive the information from each of the machines successively and to supply the control information to the actuators of each machine in relation to the position wherein it is instantaneously located, and a size-change device for each machine and including means for receiving count pulses from the revolutions counter and the control unit, said size-change device including partial counter actuable by the counting pulses, a decoder means connected to each partial counter, a plurality of swtiches connected to each partial counter forming a plurality of pairs of swtiches, each switch of a pair having an input from one of said partial counters, the output of each corresponding pair of switches forming a coincidence circuit leading to a bistable switch, said bistable switches so connected into the system as to enable the main counter to progressively count and to interrupt the count respectively by means of a polarity inverter upon the reaching of a predetermined count and simultaneously to zero set the partial counters and respectively activate them to count during the interruption of the main counter, said switches determining the count interruption of the main counter and tus the dimensions of a corresponding portion of the hosiery are vaired.

2. The electronic equipment accordng to claim 1 wherein the switching assembly includes a cyclical switching generator having a number of outputs equal to the number of machines being controlled, an angular position cyclical switch connected to said switch generator which receives information from said angular detector means of all the machines and is switched by said switching generator to subseqently supply the angular position information of the several machines to the central unit, a revolutions cyclical switch connected to said switching generator which receives information from the revolutions counter means of all the machines and is switched by said switching generator to subsequently supply the information of the revolutions completed by the several machines to the central unit, and a controls distribution cyclical switch connected to said switching generator which receives information from the central unit relating to the information instantaneoulsy received thereby, and is switched by said swtiching generator to supply control signals to the actuators of the different machines, said three switches being operated by the cyclical switching generator in such a manner that instantaneously the central unit is connected through the three switches to a designated machine to receive position information therefrom and to supply control information thereto, the switching frequency of said generator being such as to actuate all the machines in a time shorter than in which a needle cylinder under the maximum speed conditions accomplishes an angular path between two predetermined continguous angular positions, and each said angular detector including a drum having a "Gray" code impressed thereon and kinematically connected in a 1:1 ratio with said needle cylinder of the respective machine, four sensors operatively associated with said drum code, the output of each of said sensors being connected to the input of said angular position cyclical switch for transmitting angular positioned information to said central unit, the four outputs of said sensors also being connected to a four-input NAND gate which in turn is connected to the revolutions counter for generating revolutions count information.

3. The electric equipment according to claim 2 wherein a converter-decoder is connected to the output of the angular position cyclical switch for converting from "Gray" code to a "1 to 16" code, and a binary code converter-decoder is connected to a revolutions cyclical switch for converting information from the revolutions counter into a decimal code with output groups of units, tens, hundreds which in turn is fed into the central control unit.

4. The electronic equipment according to claim 3 wherein the central control unit includes a plurality of NAND logic gates corresponding in number to the control functions to be activated during each cycle, each said gate having four inputs connected to the outputs of the angular position and revolutions information coverter-decoders, and the outputs of said gates being connected to said controls distribution cyclical switch.

5. The electronic equipment according to claim 2 wherein the cyclical switching generator includes an oscillator, a pulse former, an $n$ module binary counter where $n$ is the number of machines to be controlled, and a decoder for converting from binary decimal for the information of the $n$ switchings to be supplied to the angular position, revolutions, and control distribution switches.

* * * * *